United States Patent [19]

Gohdo

[11] Patent Number: 4,643,121

[45] Date of Patent: Feb. 17, 1987

[54] METHOD OF ADDING PROPULSIVE FORCE TO ICE BREAKER

[75] Inventor: Shigeru Gohdo, Sagamihara, Japan

[73] Assignee: Nippon Kokan Kabushiki Kaisha, Tokyo, Japan

[21] Appl. No.: 731,837

[22] Filed: May 8, 1985

[30] Foreign Application Priority Data

May 31, 1984 [JP] Japan ..... 59-111370

[51] Int. Cl.[4] ..... B63B 35/08

[52] U.S. Cl. ..... 114/40; 440/34

[58] Field of Search ..... 114/40–43, 114/230, 51, 55, 253; 440/34–36, 33

[56] References Cited

U.S. PATENT DOCUMENTS

| | | | |
|---|---|---|---|
| 77,366 | 4/1868 | Flannigain | 114/42 |
| 865,193 | 9/1907 | Macklin | 114/51 |
| 1,160,257 | 11/1915 | Burns | 440/34 |
| 1,615,568 | 1/1927 | Carroll | 440/34 |
| 3,521,590 | 7/1970 | German et al. | 114/41 |
| 3,892,287 | 7/1975 | Bennett | 114/296 |
| 3,893,404 | 7/1975 | Chandler et al. | 440/34 |
| 3,971,329 | 7/1976 | Kosmatka | 114/230 |

FOREIGN PATENT DOCUMENTS

| | | | |
|---|---|---|---|
| 79441 | 10/1955 | Netherlands | 114/41 |
| 719914 | 3/1980 | U.S.S.R. | 440/34 |

*Primary Examiner*—Sherman D. Basinger
*Assistant Examiner*—Stephen P. Avila
*Attorney, Agent, or Firm*—Burgess, Ryan and Wayne

[57] ABSTRACT

A method of adding propulsive force to an ice breaker in the process of breaking ice in a frozen sea by utilizing the strong tractive force of a winch, in which a pile is first inserted in the ice, and then, a cable connected with the pile is wound up by the winch according to the advance of the ship, whereby to save fuel, and shorten the ice breaking time.

4 Claims, 3 Drawing Figures

METHOD OF ADDING PROPULSIVE FORCE TO ICE BREAKER

BACKGROUND OF THE INVENTION

This invention relates to a method of adding propulsion force to an ice breaker in the process of breaking ice in a frozen sea.

When an ice breaker navigates in a frozen sea of thick ice, continuous breaking becomes difficult. Breaking of ice is therefore usually carried out by a so-called "charging" operation. In other words, since the speed of the ship is lowered, the ship retreats and then advances to attack the ice. The hull of the ship is therefore caused to ride on the ice, so that the weight of the hull breaks the ice. However, this process requires a relatively large amount of time to break the ice, and moreover, requires the use of much fuel because of the large propulsive force that is necessary.

Various methods for solving this problem have been proposed. Two methods of notching the ice in order to easily break it are known, for example, from Japanese Utility Model Application No. 16392/1976 to Kokai. According to one of the above proposed methods, hot water or steam is injected from a nozzle provided at the bow, to form a notch in the ice. According to the other method, holes are bored in the ice by a drill provided at the bow.

A method of utilizing thermal stress is also known, for example, from Japanese Patent Application No. 1216/1980 to Kokai. According to this method, a chilling frame provided at the bow is placed on the ice, and a refrigerant such as liquid nitrogen is supplied to the frame. The ice is thereby partially chilled to form a thermal strain.

However, these methods require additional, expensive equipment. The cost of producing the thermal energy, that is, the cost of the liquid nitrogen, is also a problem.

OBJECTS AND SUMMARY OF THE INVENTION

It is an object of the present invention to provide a simple method for shortening the time for a ship to break ice and, reducing the amount of fuel consumed therein.

A method of adding propulsive force to an ice breaker ship during the process of breaking ice, comprises the steps of inserting a pile at a distance from the advancing direction of the ship, connecting one end of a cable to the pile and the other end to a winch of the ship, and adding propulsive force to the ship by winding up the cable according to the advance of the ship.

The above, and other, objects, features and advantages of the invention will be apparent from the following detailed description which is to be read together with the accompanying drawings embodying the invention.

DETAILED DESCRIPTION OF THE PREFERRED EMBODIMENTS

The present invention is characterized by utilizing the strong tractive force of a winch as part of the propulsive force of the ice breaker.

Figure 1:
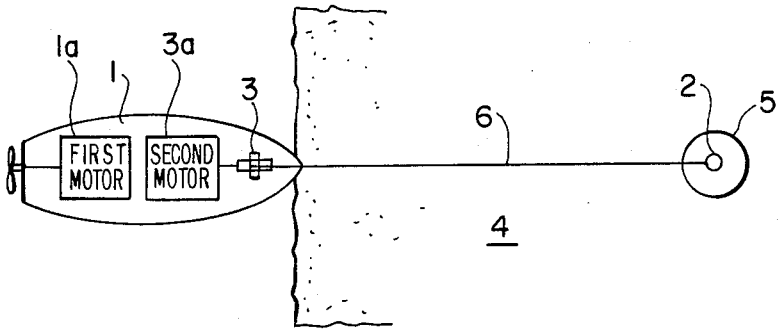
FIG. 1 is a schematic, top plan view of apparatus used to break ice according to the method of the present invention.

As shown in FIG. 1, a pile 2 is first inserted into the ice 4 at a distance from the advancing direction of an ice breaker ship 1. Ice breaker 1 has a winch 3 mounted on the forecastle deck thereof, and the size of pile 2 is determined by considering the size of ice breaker 1 and the tractive force of winch 3.

Pile 2 can be easily carried by a snowmobile, since pile 2 is preferably inserted at a long distance, such as several kilometers, from ice breaker 1.

Figure 2:
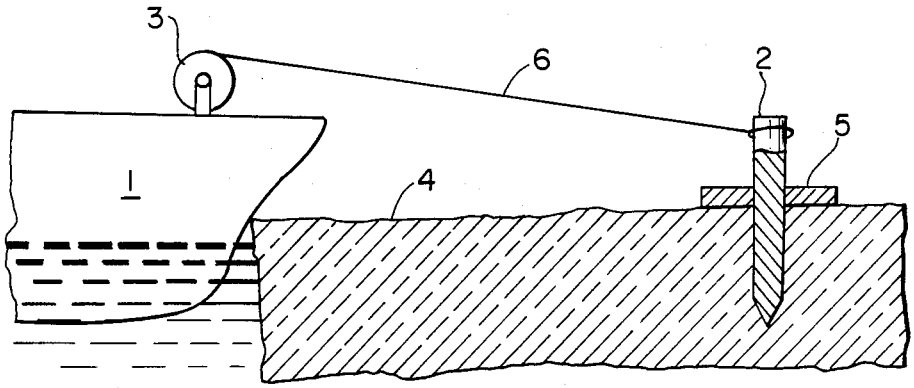
FIG. 2 is a schematic, sectional side view thereof.
Figure 3:
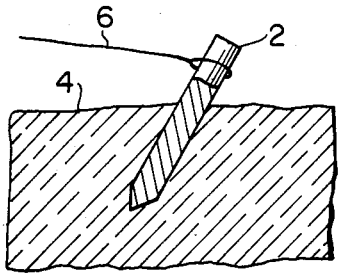
FIG. 3 is a schematic, sectional side view showing a modification of the angle of inclination of the pile within the ice.

When pile 2 is struck into ice 4, the edge of the ice is sometimes broken. Thus, a hole is first bored into ice 4 with a boring machine (not shown), and then pile 2 is inserted into the hole. The hole is preferably inclined outwardly in a direction away from ship 1 so as to increase the resistance, that is, so pile 2 is more securely held in the hole against the tractive force. A ring 5 may be provided, preferably positioned on the head of pile 2, as shown in FIG. 2, to further stabilize pile 2 in the hole and to limit the extent within which pile 2 extends into the hole. This ring 5 may previously be welded to pile 2. Ring 5 may, however, be omitted according to the hardness of the ice.

A projection, a hook, a penetrated hole, a peripheral groove or the like (not shown) engaging one end of a cable 6 may be formed at the head of pile 2. For example, an eye may be formed at the end of cable 6, and this eye may be engaged with the head of pile 2. A cable 6, therefore extends between winch 3 and pile 2, although connecting means other than cable 6 may be used.

After cable 6 is connected with pile 2, cable 6 is stretched by actuating a motor 3*a* of winch 3 which constitutes a second motor used in addition to the first or primary propulsive motor 1*a* of ship 1. Ship 1 is then advanced, and cable 6 is wound up as ship 1 advances. When the thickness of ice 4 increases, the aforementioned charging operation may also be necessary. In such case, when ship 1 retreats, winch 3 is freed to provide slack in cable 6, and as ship 1 advances, cable 6 is wound up by winch 3.

According to the method of the present invention, the strong tractive force of winch 3 is utilized as part of the propulsive force of the ship. When a steel pile having a diameter of 1 meter is sunk 2 meters into the ice, this steel pile is capable of bearing a tractive force of 100 tons. Since a tractive force of 1 ton corresponds to a propulsive force of about 100 horsepower, a propulsive force corresponding to a 10,000-horsepower engine is obtained by using the pile and winch arrangement according to the present invention having a tractive force of 100 tons. Accordingly, when the propulsive force of an ice breaker is 10,000 horsepower, the propulsive force may be doubled by employing the method according to the present invention.

The equipment necessary for performing the method of the present invention includes a winch, a pile, a boring machine for forming the hole for the pile, and a cart for conveying the pile. Such equipment may be derived from fittings of the ship, such as winches, and a snowmobile.

The method according to the invention is therefore relatively simple, but nevertheless, it sharply saves fuel and may shorten the breaking time of the ice.

Having described specific preferred embodiments of the invention with reference to the accompanying drawings, it is to be appreciated that the present invention is not limited to those precise embodiments, and that various changes and modifications may be effected therein by one of ordinary skill in the art, without departing from the scope and spirit of the invention as defined by the appended claims.

What is claimed is:

1. A method of adding propulsive force to an ice breaker ship during the process of breaking a large, solid piece of ice, comprising the steps of:

inserting a pile at a substantial distance from the advancing direction of said ship to permit a substantially continuous movement of the ship over a long distance;

connecting one end of a cable to said pile and the other end to winch means of said ship, said winch means including second motor means for winding up said cable, driving the ice breaker ship through the ice by first motor means; and adding propulsive force to said ship by winding up said cable about said winch means by said second motor means thereof according to the advance of said ship by said first motor means.

2. The method according to claim 1, wherein said distance is several kilometers.

3. The method according to claim 1, wherein said hole is inclined outwardly away from said ship.

4. The method according to claim 1, further comprising the step of positioning a ring on said pile to stabilize said pile.

* * * * *